United States Patent [19]

Gründler

[11] Patent Number: 4,561,572

[45] Date of Patent: Dec. 31, 1985

[54] APPARATUS FOR DISPENSING BULK GOODS

[75] Inventor: Bruno Gründler, Neuhausen am Rheinfall, Switzerland

[73] Assignee: SIG Schweizerische Industrie Gesellschaft, Neuhausen am Rheinfall, Switzerland

[21] Appl. No.: 541,662

[22] Filed: Oct. 13, 1983

[30] Foreign Application Priority Data

Oct. 27, 1982 [CH] Switzerland ..... 6279/82

[51] Int. Cl.[4] ..... B65D 88/26

[52] U.S. Cl. ..... 222/410; 222/461; 222/533; 141/284; 141/252

[58] Field of Search ..... 222/410, 414, 368, 461, 222/533; 193/20, 21, 3, 32; 53/244, 248; 239/668, 689; 141/256, 284

[56] References Cited

U.S. PATENT DOCUMENTS 2,297,382 9/1942 Augustin ..... 222/410
2,546,702 3/1951 Ready ..... 222/513
3,536,235 10/1970 Holzhauer et al. ..... 222/368
4,165,823 8/1979 Olsson ..... 222/368

FOREIGN PATENT DOCUMENTS 373684 1/1964 Switzerland .

*Primary Examiner*—Joseph J. Rolla
*Assistant Examiner*—Andrew Jones
*Attorney, Agent, or Firm*—Spencer & Frank

[57] ABSTRACT

An apparatus for dispensing bulk material comprises a supply chute having an outlet; an openable and closable gate in the supply chute for controlling discharge of the bulk material from the outlet; and a downwardly oriented funnel extending below the outlet of the supply chute. The funnel includes an inlet zone for receiving material from the supply chute; a discharge opening situated below the inlet zone for discharging material from the apparatus; a generally planar wall extending from the inlet zone to the discharge opening; and a constricted flow passage area below the inlet zone. A rotor of flat construction is situated in the inlet zone in the vicinity of the funnel wall between the outlet of the supply chute and the constricted flow passage area.

8 Claims, 3 Drawing Figures

APPARATUS FOR DISPENSING BULK GOODS

BACKGROUND OF THE INVENTION

This invention relates to a dispensing apparatus for filling upwardly open boxes with measured quantities of bulk goods. The upwardly open boxes are sequentially advanced to the apparatus which includes a supply chute which is closable by a gate and in which a predetermined quantity of the bulk goods is readied for discharge from the apparatus.

Swiss Pat. No. 373,684 discloses an apparatus for dispensing bulk goods, for example, potato chips, into bags by means of a funnel. For preventing the potato chips which are of non-uniform size and shape, from blocking the funnel, there is provided a rotating element, a so-called "breaker wing" whose axis of rotation extends parallel-spaced from the funnel axis. The breaker wing is a helically bent wire turned with approximately 200 rpm. The purpose of the breaker wing is to break up potato chips which accumulate in the funnel in order to ensure a uniform outflow of the goods. In case of a continuous flow, the breaker wing does not strike the goods.

In case of coarse, block-shaped bulk goods, such as compressed cornflakes which have a dimension of $4\times2.5\times2$ cm, the individual blocks must not be damaged in any manner during filling, otherwise the compressed blocks may fall apart into small flakes which will lend an unsightly appearance to the entire contents of the package.

SUMMARY OF THE INVENTION

It is an object of the invention to provide an improved apparatus of the above-outlined type which prevents obstructions by relatively large and very delicate bulk goods and by means of which a continuous flow may be ensured without striking the material which could effect breakage thereof.

This object and others to become apparent as the specification progresses, are accomplished by the invention, according to which, briefly stated, underneath an opening of the supply chute there is provided a funnel whose outlet end is, at least in the transporting direction of the packaging box, narrowed to at least the largest predictable surface extension of pieces of the bulk goods and further, the funnel has a planar wall extending from the funnel inlet to the funnel outlet. Further, next to the planar wall, a flat rotor is provided between the outlet opening of the supply chute and the constriction in the funnel.

DESCRIPTION OF THE PREFERRED EMBODIMENTS

Figure 2:
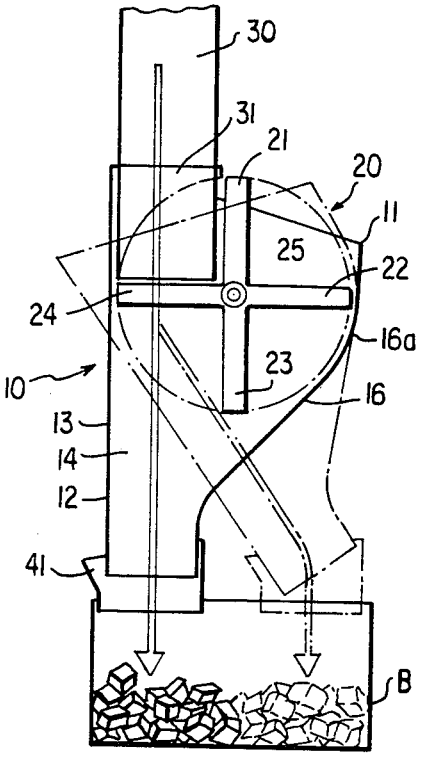
FIG. 2 is a schematic front elevational view of the preferred embodiment.
Figure 1:
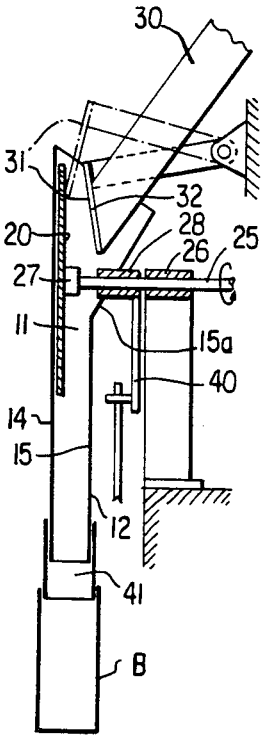
FIG. 1 is a schematic sectional side elevational view of a preferred embodiment of the invention.

Turning to FIGS. 1 and 2, there is illustrated a first preferred embodiment of the invention. The structure includes a funnel 10 having an upper, inlet or charging zone 11 which tapers downwardly in a wedge-like manner and a lower, outlet or discharge part 12. The funnel 10 has a narrow planar side wall 13 and a wide side wall

14, oriented perpendicularly to one another, a wide side wall 15 which faces the wide side wall 14 and which is outwardly bent at 15*a*, as well as a fourth wall 16 which is of arcuate outline at 16*a* and forms a transition from the charging zone 11 to the discharge part 12. The discharge part or opening 12 is formed by the four walls 13–16 and has a rectangular cross-sectional shape.

In the vicinity of the wide planar wall 14 there is arranged a rotor 20 which has four impeller blades 21, 22, 23 and 24 formed of straight plate members. The blades 21–24 rotate in a plane which is in the immediate vicinity of the wall 14 and which extends parallel thereto. A drive shaft 25 is rotatably supported in a horizontal orientation in a stationary bearing 26 and is fixedly attached to a hub 27 of the rotor 20. The drive shaft 25 also serves as a support shaft for a pivot sleeve 28 affixed to the funnel 10. In this manner the funnel 10, as best shown in FIG. 2, may swing back and forth in a generally vertical plane between a first position shown in solid lines and a second position shown in dashed lines, for evenly charging a box B positioned under the outlet 12 of the funnel 10. The swinging motion of the funnel 10 may be effected by a drive 40 and may be coordinated with an advancing mechanism for receptacles B to swing back and forth above a stationary receptacle or to follow it during its advance.

Bulk goods which are held in readiness in dosed quantities in a supply chute 30 may fall through the above-described construction into the funnel 10 as a gate 31 controlling the outlet 32 of chute 30 is placed from a closed position into an open position. The outlet 32 is preferably oriented towards the blades 21–24 of the rotor 20. The turning rotor 20 prevents the items of the bulk material from jamming in the narrowing space of the charging part 11. Such an obstruction would partially or entirely block the free passage of the metered quantity. Particularly in charging receptacles which are advanced stepwise, care has to be taken that all parts of a dose are securely deposited into the receptacle during the available time period.

By means of the above-described structure, including the arrangement of the supply chute 30 it is ensured that the material falls against the rotor 20 under its own weight and is immediately directed downwardly. In the charging zone 11 of the funnel 10 the cross-sectional area is not significantly narrowed by the rotor 20 because the latter has a flat construction and is situated in the vicinity of one of the side walls.

The outlet portion 12 may be equipped with a conventional funnel end portion 41 which in every position of the discharge part 12 ensures that the bulk material will fall into the receptacle B. The outlet 32 of the supply chute 30 and the discharge opening 12 of the funnel 10 are preferably in a vertical alignment with one another.

Figure 3:
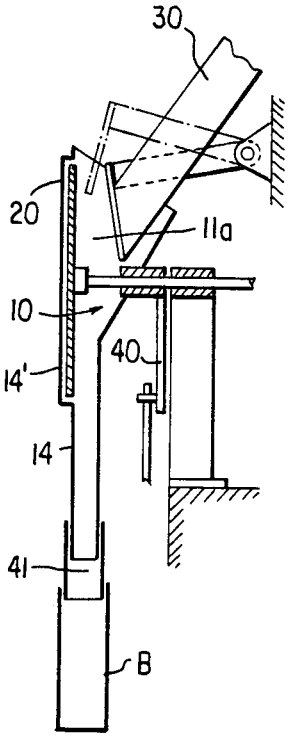
FIG. 3 is a schematic sectional side elevational view of another preferred embodiment of the invention.

Turning now to FIG. 3, there is shown another preferred embodiment of the invention. In this embodiment the wider wall 14 may be provided with a bay portion 14' to accommodate the rotor 20. In this manner the charging or inlet zone 11*a* of the funnel is not reduced and the conveying effect of the rotor remains undiminished.

By selecting the direction of rotation of the rotor 20, the bulk material may be adjusted since a rotation opposing the free fall reduces the velocity of the material.

It will be understood that the above description of the present invention is susceptible to various modifications, changes and adaptations, and the same are intended to be comprehended within the meaning and range of equivalents of the appended claims.

What is claimed is:

1. An apparatus for dispensing bulk material comprising (a) a supply chute having an outlet;

(b) an openable and closable gate in said supply chute for controlling discharge of the bulk material from said outlet;

(c) a downwardly oriented funnel extending below the outlet of said supply chute; said funnel including (1) an inlet zone receiving material from said outlet of said supply chute and defining a generally downwardly oriented, substantially unobstructed path for the material from said outlet of said supply chute throughout said inlet zone;

(2) a discharge opening situated below said inlet zone for discharging material from the apparatus;

(3) a generally vertically oriented, generally planar wall extending from said inlet zone to said discharge opening; and (4) a constricted flow passage area below said inlet zone;

(d) a rotor of flat construction situated in said inlet zone in the vicinity of said wall between said outlet of said supply chute and said constricted flow passage area; said rotor including a generally horizontally supported shaft and revolving impeller means having a path of rotation spaced from said outlet in a horizontal direction; said path of rotation extending parallel to said wall and bounding said unobstructed path; and (e) means for pivotally supporting said funnel on said shaft for swinging motion in a vertical plane.

2. An apparatus as defined in claim 1, wherein said path of rotation extends in the immediate vicinity of said wall.

3. An apparatus as defined in claim 1, wherein said rotor has an axis of rotation and further where in said impeller means comprises a plurality of impeller blades supported radially with respect to said axis.

4. An apparatus as defined in claim 1, wherein said outlet of said supply chute is oriented towards said wall and said impeller means.

5. An apparatus as defined in claim 1, wherein said wall of said funnel is a first wall; said funnel further having second, third and fourth walls; said discharge opening of said funnel having a rectangular cross section and being formed by said first, second, third and fourth walls; said second and third walls being generally planar; said fourth wall being situated opposite said first wall and having an arcuate surface configuration; said outlet of said supply chute and said discharge opening of said fuel being in an approximate vertical alignment with one another.

6. An apparatus as defined in claim 1, further comprising drive means operatively coupled to said funnel for imparting swinging motions to said funnel.

7. An apparatus for dispensing bulk material comprising (a) a supply chute having an outlet;

(b) an openable and closable gate in said supply chute for controlling discharge of the bulk material from said outlet;

(c) a downwardly oriented funnel extending below the outlet of said supply chute; said funnel including (1) an inlet zone for receiving material from said outlet of said supply chute;

(2) a discharge opening situated below said inlet zone for discharging material from the apparatus;

(3) a generally planar wall extending from said inlet zone to said discharge opening; and (4) a constricted flow passage area below said inlet zone;

(d) a rotor of flat construction situated in said inlet zone in the vicinity of said wall between said outlet of said supply chute and said constricted flow passage area; said rotor having a generally horizontally supported shaft; and (e) means for pivotally supporting said funnel on said shaft for swinging motion in a vertical plane.

8. An apparatus as defined in claim 7, further comprising drive means operatively coupled to said funnel for imparting swinging motions to said funnel.

* * * * *